US010986918B2

(12) United States Patent
Xiang et al.

(10) Patent No.: US 10,986,918 B2
(45) **Date of Patent: *Apr. 27, 2021**

(54) LIFTING TABLE

(71) Applicant: Loctek Inc., Livermore, CA (US)

(72) Inventors: Lehong Xiang, Ningbo (CN); Linghui Jiang, Ningbo (CN); Xufeng Chen, Ningbo (CN)

( * ) Notice: Subject to any disclaimer, the term of this patent is extended or adjusted under 35 U.S.C. 154(b) by 0 days.

This patent is subject to a terminal disclaimer.

(21) Appl. No.: 16/595,477

(22) Filed: Oct. 8, 2019

(65) Prior Publication Data

US 2020/0029683 A1 Jan. 30, 2020

Related U.S. Application Data

(63) Continuation of application No. PCT/CN2018/108313, filed on Sep. 28, 2018.

(30) Foreign Application Priority Data

Dec. 22, 2017 (CN) ..... 201711404799.0

(51) Int. Cl.
*A47B 9/16* (2006.01)
*A47B 21/02* (2006.01)

(52) U.S. Cl.
CPC ..... *A47B 9/16* (2013.01); *A47B 21/02* (2013.01); *A47B 2200/0056* (2013.01)

(58) Field of Classification Search
CPC ..... A47B 9/16; A47B 21/02; A47B 21/0314; A47B 2121/0335; A47B 3/00;
(Continued)

(56) References Cited

U.S. PATENT DOCUMENTS 4,221,280 A * 9/1980 Richards ..... B66F 7/065 187/269
4,926,760 A * 5/1990 Sack ..... B65G 1/07 108/145

(Continued)

FOREIGN PATENT DOCUMENTS

CN 103663257 A 3/2014
CN 203913916 U 11/2014

(Continued)

OTHER PUBLICATIONS

International Search Report of PCT/CN2018/108313, dated Jan. 7, 2019.

*Primary Examiner* — Jose V Chen
(74) *Attorney, Agent, or Firm* — W&K IP

(57) ABSTRACT

The present disclosure discloses a lifting table, has a tabletop plate, a table-supporting frame connected with the tabletop plate, a base, an X-shaped supporting leg for connecting the table-supporting frame and the base, and a power driving device controlling the open-and-close of the X-shaped supporting leg to achieve the lifting of the tabletop plate, the power driving device is connected to the table-supporting frame, and the power output end of the power driving device is connected with the X-shaped supporting leg; the lifting table further comprises an inclined connecting rod mechanism which always applies an oblique force to the X-shaped supporting leg; one end of the inclined connecting rod mechanism is connected to the X-shaped supporting leg, and the other end of the inclined connecting rod mechanism is connected to the power driving device.

8 Claims, 6 Drawing Sheets

(58) Field of Classification Search
CPC .... A47B 2200/0056; A47B 2200/0046; A47B 2021/0335; B66F 7/0608; B66F 7/065; F16M 11/046; F16M 11/38; F16M 11/24; F16M 11/2014; F16M 11/2092
USPC ..... 108/118, 116, 117, 145, 147, 144.11; 254/122
See application file for complete search history.

(56) References Cited

U.S. PATENT DOCUMENTS 4,995,130 A * 2/1991 Hahn ..... B65G 69/2823 14/71.3
5,005,492 A * 4/1991 Ogino ..... B66F 7/0641 108/145
5,322,143 A * 6/1994 Curran ..... B66F 7/065 187/211
5,476,050 A * 12/1995 Zimmer ..... B66F 11/042 100/147
5,588,377 A * 12/1996 Fahmian ..... A47B 9/00 108/145
5,632,209 A * 5/1997 Sakakibara ..... A47B 9/02 108/145
5,694,864 A * 12/1997 Langewellpott ..... B66F 7/0608 108/145
5,823,120 A * 10/1998 Holmquist ..... A47B 9/02 108/147
6,038,986 A * 3/2000 Ransil ..... A47B 9/02 108/145
8,015,638 B2 * 9/2011 Shimada ..... A47C 19/04 108/145
8,132,518 B2 * 3/2012 Kim ..... B66F 7/0633 108/145
8,424,883 B1 * 4/2013 Ramos ..... B62B 3/02 108/145
9,504,316 B1 11/2016 Streicher et al.
10,264,877 B2 * 4/2019 Hu ..... A47B 9/02
10,517,390 B2 * 12/2019 Xiang ..... A47B 9/16
2003/0154890 A1 * 8/2003 Warner ..... A47B 9/00 108/145
2006/0037518 A1 * 2/2006 Lopez Alba ..... A47B 9/16 108/145
2007/0034125 A1 * 2/2007 Lo ..... B66F 7/0666 108/145
2010/0012909 A1 * 1/2010 Lee ..... B66F 7/085 254/93 R
2015/0289641 A1 * 10/2015 Ergun ..... A47B 9/16 108/42
2016/0338486 A1 * 11/2016 Martin ..... A47B 9/16
2017/0354245 A1 * 12/2017 Martin ..... A47B 21/02
2018/0055214 A1 * 3/2018 Kim ..... A47B 9/10
2018/0146775 A1 * 5/2018 You ..... A47B 9/16
2018/0192769 A1 * 7/2018 Xiang ..... A47B 21/02

FOREIGN PATENT DOCUMENTS

CN 205947441 U 2/2017
CN 107136750 U 9/2017
JP H10179272 A 7/1998

* cited by examiner

LIFTING TABLE

CROSS-REFERENCE TO RELATED APPLICATIONS

This application is a continuation of International Patent Application No. PCT/CN2018/108313 with an international filing date of Sep. 28, 2018, designating the United States, and further claims priority benefits to Chinese Patent Applications No. 201711404799.0, filed on Dec. 22, 2017, The contents of all of the aforementioned applications, including any intervening, amendments thereto, are incorporated herein by reference.

TECHNICAL FIELD

The present disclosure relates to the technical field of furniture, in particular to a lifting table.

BACKGROUND

Recently, a lifting table placed on a desktop has gained more and more popularity in daily life, mostly used in fields of study, office, entertainment and the alike. The lifting table generally comprises a table plate, a base and a lifting support frame. The table plate is connected to the base through the lifting support frame; the base is placed on the desktop, and usually a motor acting as the driving device to control the lifting support frame to achieve the electric lifting function. As an application named as "An Electric Lifting Table" disclosed as CN103663257A on the website of State Intellectual. Property Office comprises a loading platform, a bottom plate, a transmission assembly and at least one set of lifting assembly. The loading platform and the bottom plate are respectively connected to the upper and the lower end of the lifting assembly, the lifting assembly comprises a first supporting arm and a second supporting arm which are cross-hinged to each other; the transmission assembly comprises a motor and a sliding plate, the main shaft of the motor is connected with a screw rod, and the sliding plate is slidably connected to the bottom plate, the screw rod is connected with the sliding plate; the two ends of the first supporting arm are respectively hinged to the loading platform and the sliding plate, which is to say that the sliding plate slides on the bottom plate after the motor drives the screw rod to rotate and the lower end of the first supporting arm is driven to slide on the bottom plate, so that the purpose of lifting the loading platform is achieved. However, there are some disadvantages of the electric lifting table with this structure:

Due to the fact that the driving force always acts on the lower end of the flat arm of the bottom plate, the supporting arm is swaying while its bottom sliding horizontally along the bottom plate; the force acting on the bottom of the supporting arm varies when it swings, especially in the instant when the supporting arm just starts to slide, the driving force is in its maximum. In order to ensure the smooth movement of the supporting arm, the output power of the motor should be sufficient. As a result, if a large driving force is required, a motor of proper specification with corresponding larger volume may be chosen, which occupies more space in the lifting table and the weight of the entire lifting table is increased as well as the size of the parts, making the lifting table more cumbersome. If a small driving force is selected, a smaller motor is available but insufficient pushing force makes the lifting, process more difficult or even leads to lifting failure. Moreover, when the loading platform stays at any position, due to the lacking of a locking structure for the supporting arm, the total weight of the loading platform together with the object(s) above will press down the supporting arm, resulting in a downward tendency of the loading platform and a poor stability.

SUMMARY

One objective of the present disclosure is to solve the technical problem by providing a high-stability lifting, table with an auxiliary acting force for the supporting arm to achieve easier lifting without changing the specifications of the motor and is able to stay at any position.

In order to solve the above mentioned technical problem, the present disclosure provides a lifting table, comprises a tabletop plate, a table-supporting frame connected with the tabletop plate, a base, an X-shaped supporting leg for connecting the table-supporting frame and the base, and a power driving device controlling the open-and-close of the X-shaped supporting leg to achieve the lifting of the tabletop plate, the power driving device is connected to the table-supporting frame, and the power output end of the power driving device is connected with the X-shaped supporting leg; the lifting table further comprises an inclined connecting rod mechanism which always applies an oblique force to the X-shaped supporting leg, one end of the inclined connecting rod mechanism is connected to the X-shaped supporting leg, and the other end of the inclined connecting rod mechanism is connected to the power driving device.

The inclined connecting rod mechanism comprises a long connecting rod and two short connecting rods; one end of the long connecting rod is hinged to the power output end of the power driving device and the other end of the long connecting rod is hinged to one end of the two short connecting rods respectively; the other ends of the two short connecting rods are in fixed connection with the X-shaped supporting leg; and an included angle is always formed between the long connecting rod and the power output direction of the power driving device.

The power driving device comprises a motor connecting, seat, a motor, a screw rod, and a slider; the motor connecting seat is connected onto the tabletop plate and the motor is fixedly connected onto the motor connecting seat; an output shaft of the motor is connected with one end of the screw rod through a transmission mechanism; the slider is in, threaded connection with the screw rod; the other end of the screw rod is rotationally connected with the table-supporting frame.

The table-supporting frame comprises two cross beams and two guide rails; the two cross beams are connected to the front and rear side of the tabletop plate respectively; the motor is connected to one end of the cross beam, and the two guide rails are respectively connected to one end of the two cross beams, the end of which is far away from the motor.

The X-shaped supporting leg comprises two X-shaped supporting sets; each X-shaped supporting set is formed by a first supporting leg and a second supporting leg hinged into an X-shape cross; each X-shaped supporting set consists of four supporting points a first supporting point for the connection of the table-supporting frame and one end of the first supporting leg; a second supporting, point for the connection of the table-supporting frame and one end of the second supporting leg; a third supporting point for the connection of the base and the other end of the first supporting leg; a fourth supporting point for the connection of the base and the other end of the second supporting leg; the second supporting points of the two X-shaped supporting sets are connected with each other through a second connecting shaft; the fourth supporting points of the two X-shaped supporting sets are connected with each other through a fourth connecting shaft; the two ends of the second connecting shaft are respectively hinged into the two guide rails in a sliding connection; the two ends of the fourth connecting shaft are respectively hinged onto the base in a sliding connection; the first supporting point is hinged to one end of the cross beam, the end of which close to the motor; the third supporting point is hinged on the base; one end of the short connecting rod is fixedly connected to the end of the first supporting leg, the end of which close to the end of the tabletop plate.

The first supporting points of the two X-shaped supporting sets are connected with each other through a first connecting shaft; the two ends of the first connecting shaft are hinged to the two cross beams respectively; the two ends of the two first supporting legs are fixedly connected to the outer circumferential wall of the first connecting shaft.

An intermediate beam is arranged between the middle portions of the two cross beams; the two ends of the intermediate beam are fixedly connected with the two cross beams respectively; a hanging plate is connected to the intermediate beam, and the other end of the screw rod is hinged to the hanging plate.

A housing is provided outside the screw rod and the slider; the end of the housing is fixedly connected with the hanging plate.

A tact switch is arranged at the bottom of the motor to prevent the motor from colliding with the base when the tabletop plate is lowered to the lowest position; the contact point of the tact switch facing to the base.

With the above described structure, the present disclosure has the following advantages compared with the prior art:

1) Since the power output shaft exerts an oblique force on the upper portion of the X-shaped supporting, leg through the inclined connecting rod mechanism, even when the X-shaped supporting leg is in a folded state, i.e. the tabletop plate stays at the lowest position. When the tabletop plate starts to rise from the lowest position, the oblique force on the X-shaped supporting leg always provided by the long connecting rod assists the driving force of the motor, effectively reducing the starting force of the motor when the tabletop plate is located at the lower position, thus maximizing the efficiency of the motor. There is no need to increase the output power of the motor, and with reduced volume and weight, the lifting table is made more portable. Meanwhile, the force of the inclined connecting rod mechanism is decomposed into a vertical upward supporting force, so that the X-shaped supporting leg provides a much better and more stable supporting effect for the tabletop plate.

2) The inclined connecting rod mechanism adopts a combined structure of a long connecting rod and a short connecting rod, which is of simple structure, stable movement and higher efficiency of force transfer.

3) With the tact switch arranged, there is a warning and limit function when the tabletop plate reaches the lowest position, which makes the electric lifting table safer and more reliable.

Figure 1:
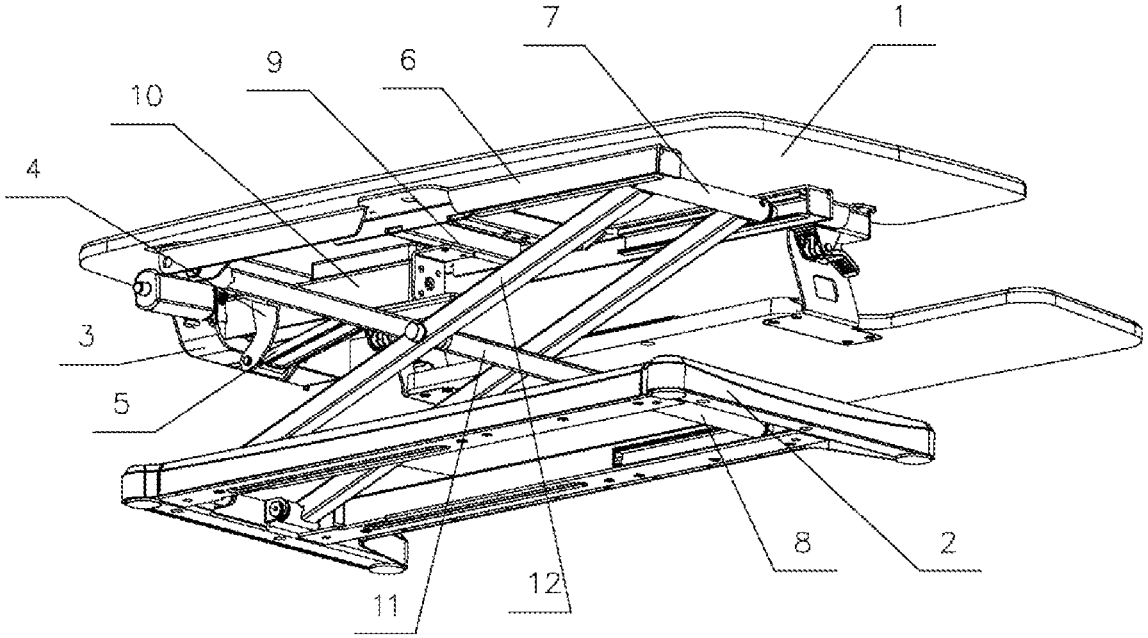
FIG. 1 is a structural schematic diagram of the lifting table of the present disclosure
Figure 2:
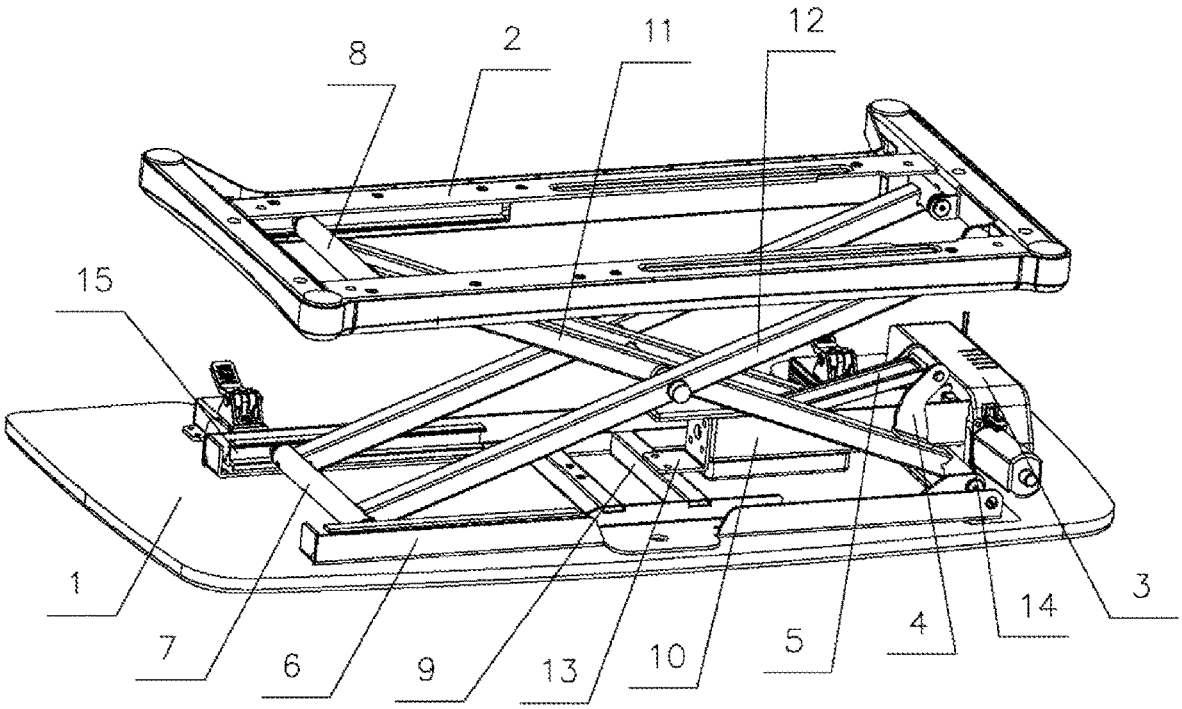
FIG. 2 is a structural schematic diagram of the lifting table of the present disclosure when inverted.
Figure 3:
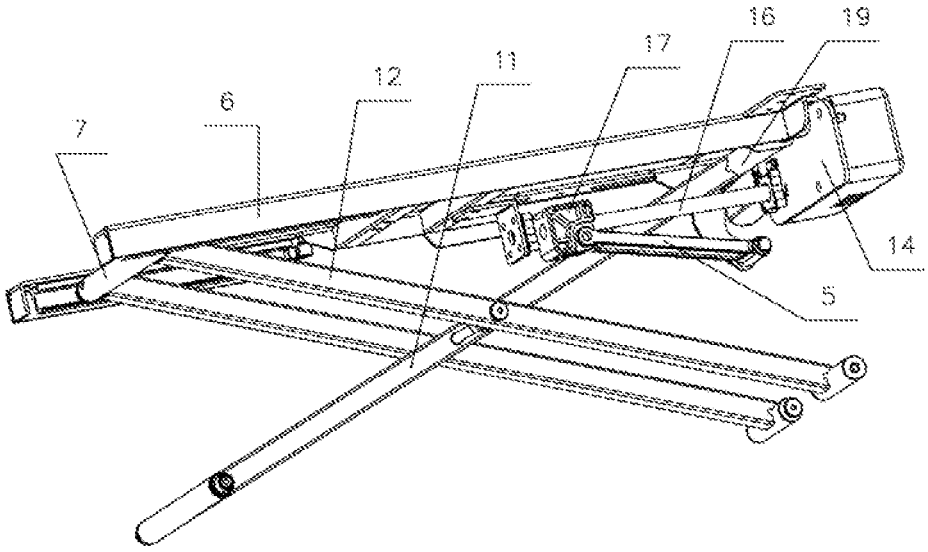
FIG. 3 is a partial structural schematic diagram of the lifting table of the present disclosure.
Figure 4:
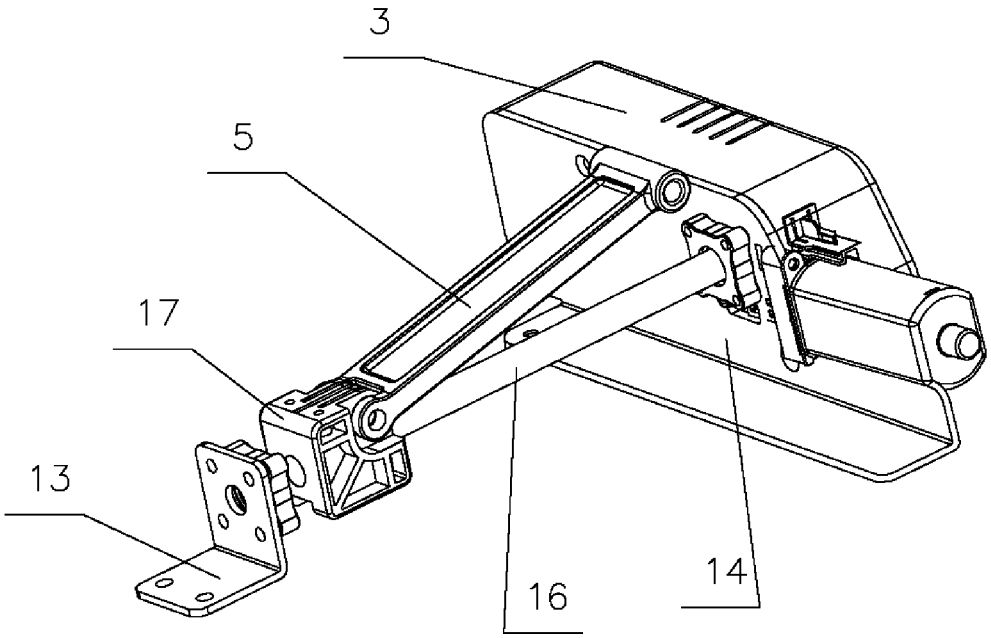
FIG. 4 is a partial structural schematic diagram of the lifting table of the present disclosure.
Figure 5:
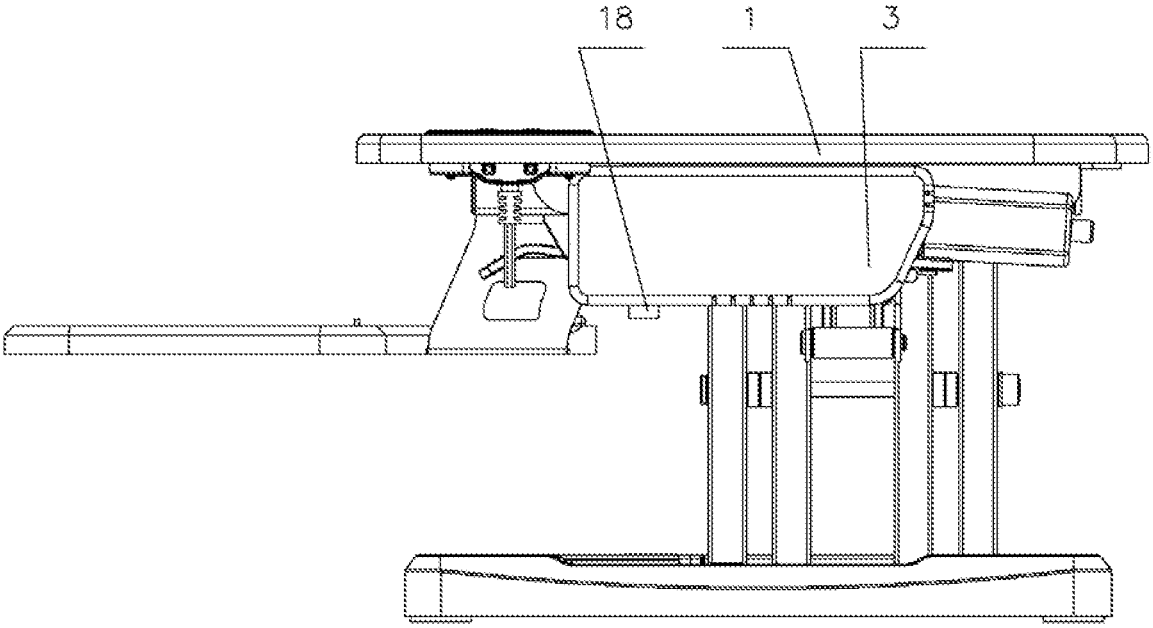
FIG. 5 is a side elevational view of the lifting table of the present disclosure.

Among them: 1, tabletop plate; 2, base; 3, motor; 4, short connecting rod; 5, long connecting rod; 6, cross beam; 7, second connecting shaft; 8, fourth connecting shaft; 9, intermediate beam; 10, housing; 11, first supporting leg; 12, second supporting leg; 13, hanging plate; 14, motor connecting seat; 15, guide rail; 16, screw rod; 17, slider; 18, tact switch.

DETAILED DESCRIPTION

Various aspects of the illustrative embodiments of the present disclosure will be described herein using terms commonly employed by those skilled in the art.

As shown in the structural schematic diagrams of the lifting table of the present disclosure in FIG. 1-FIG. 6, a lifting table comprises a tabletop plate 1, a table-supporting frame connected with the tabletop plate 1, a base 2, an X-shaped supporting leg for connecting the table-supporting frame and the base 2, and a power driving device controlling the open-and-close of the X-shaped supporting leg to achieve the lifting of the tabletop plate 1; the power driving device is connected to the table-supporting frame, and the power output end of the power driving device is connected with the X-shaped supporting leg; the lifting table further comprises an inclined connecting rod mechanism which always applies an oblique force to the X-shaped supporting leg; one end of the inclined connecting rod mechanism is connected to the X-shaped supporting leg, and the other end of the inclined connecting rod mechanism is connected to the power driving device.

The inclined connecting rod mechanism comprises a long connecting rod 5 and two short connecting rods 4; one end of the long connecting rod 5 is hinged to the power output end of the power driving device and the other end of the long connecting rod 5 is hinged to one end of the two short connecting rods 4 respectively; the other ends of the two short connecting rods 4 are in fixed connection with the X-shaped supporting leg; and an included angle is always formed between the long connecting rod 5 and the power output direction of the power driving device.

The power driving device comprises a motor connecting seat 14, a motor 3, a screw rod 16, and a slider 17; the motor connecting seat 14 is connected onto the tabletop plate 1 and the motor 3 is fixedly connected onto the motor connecting seat 14; an output shaft of the motor 3 is connected with one end of the screw rod 16 through a transmission mechanism; the slider 17 is in threaded connection with the screw rod 16; the other end of the screw rod 16 is rotationally connected with the table-supporting frame while the slider 17 is hinged with one end of the long connecting rod 5.

The table-supporting frame comprises two cross beams 6 and two guide rails 15; the two cross beams 6 are connected to the front and rear side of the tabletop plate 1 respectively; the motor 3 is connected to one end of the cross beam 6, and the two guide rails 15 are respectively connected to one end of the two cross beams 6, the end of which is far away from the motor 3.

The X-shaped supporting leg comprises two X-shaped supporting sets; each X-shaped supporting set is formed by a first supporting leg 11 and a second supporting leg 12 hinged into an X-shape cross; each X-shaped supporting set consists of four supporting points: a first supporting point for the connection of the table-supporting frame and one end of the first supporting leg 11; a second supporting point for the connection of the table-supporting frame and one end of the second supporting leg 12, a third supporting point for the connection of the base 2 and the other end of the first supporting leg 11; a fourth supporting point for the connection of the base 2 and the other end of the second supporting leg 12; the second supporting points of the two X-shaped supporting sets are connected with each other through a second connecting shaft 7; the fourth supporting points of the two X-shaped supporting sets are connected with each other through a fourth connecting shaft 8; the two ends of the second connecting shaft 7 are respectively hinged into the two guide rails 15 in a sliding connection; the two ends of the fourth connecting shaft 8 are respectively hinged onto the base 2 in a sliding connection; the first supporting point is hinged to one end of the cross beam 6, the end of which close to the motor 3; the third supporting point is hinged on the base 2; one end of the short connecting rod 4 is fixedly connected to the end of the first supporting leg 11, the end of which close to the end of the tabletop plate 1.

The first supporting points of the two X-shaped supporting sets are connected with each other through a first connecting shaft 19; the two ends of the first connecting shaft 19 are hinged to the two cross beams 6 respectively; the two ends of the two first supporting legs 11 are fixedly connected to the outer circumferential wall of the first connecting shaft 19.

The intermediate beam 9 is arranged between the middle portions of the two cross beams 6; the two ends of the intermediate beam 9 are fixedly connected with the two cross beams 6 respectively; a hanging plate 13 is connected to the intermediate beam 9, and the other end of the screw rod 16 is hinged to the hanging plate 13.

The housing 10 is provided outside the screw rod 16 and the slider 17; the end of the housing 10 is fixedly connected with the hanging plate 13.

The tact switch 18 is arranged at the bottom of the motor 3 to prevent the motor 3 from colliding with the base 2 when the tabletop plate 1 is lowered to the lowest position, the contact point of the tact switch 18 facing to the base 2.

Figure 6:
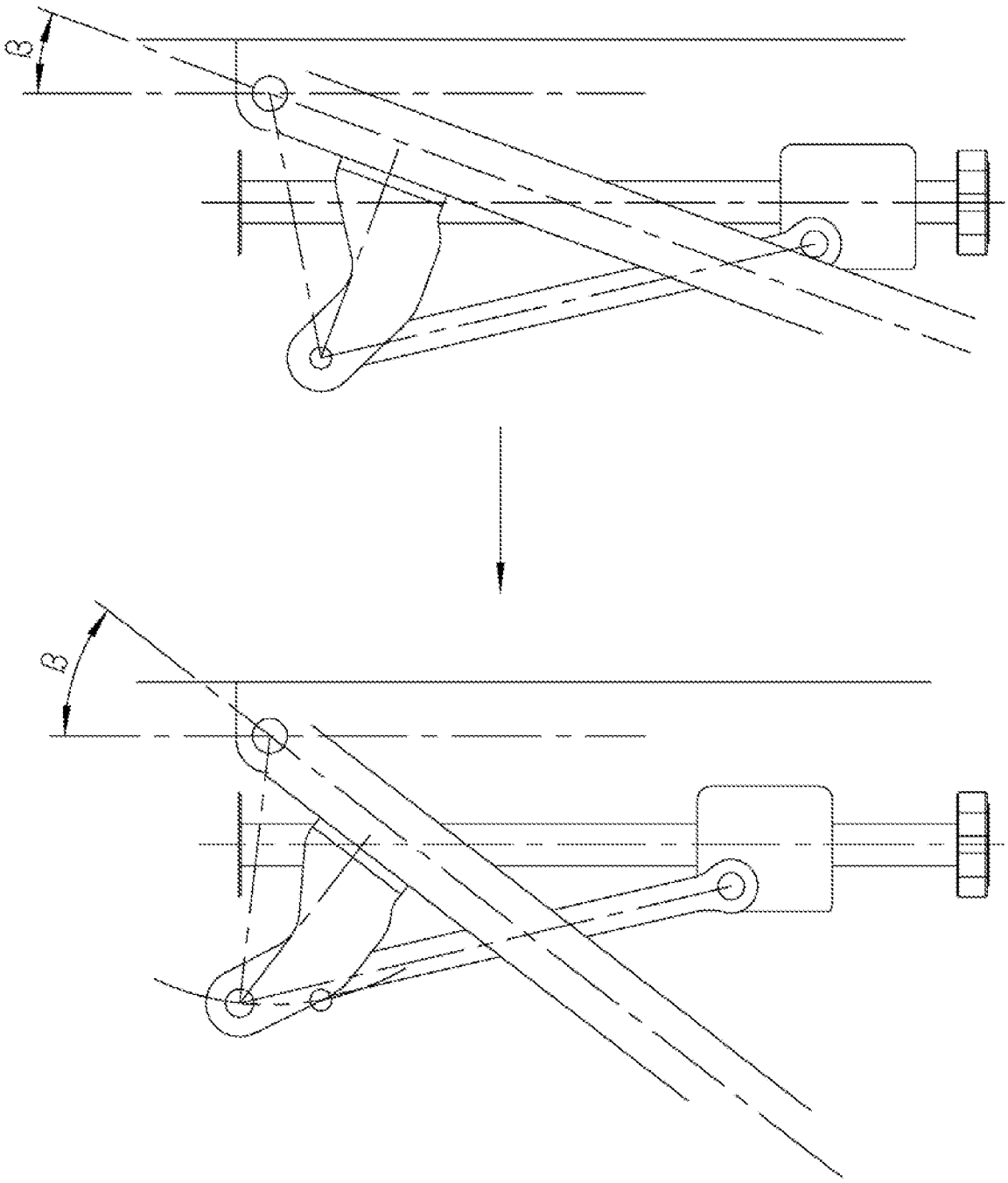
FIG. 6 is a structural schematic diagram of the inclined connecting rod mechanism of the lifting table of the present disclosure from a folded state to an open state.

The operation process of the present disclosure: when the lifting table rises, start motor 3, and the screw rod 16 rotates to drive the slider 17 to slide on the screw rod 16 in a horizontal direction; through the force transmission of the inclined connecting rod mechanism of the long connecting rod 5 and the short connecting rod 4, the first supporting leg 11 is driven to rotate around the first supporting point, meanwhile, the second connecting shaft 7 and the fourth connecting shaft 8 slide respectively on the cross beam 6 and the base 2, so that the X-shaped supporting leg is opened, and until it reaches to an appropriate position to stop the motor. As shown in FIG. 6, the included angle ß between the first supporting leg 11 and the tabletop plate 1 in the horizontal direction increases from the folded state to the open state. Conversely, when the lifting table descends, the motor 3 is reversely activated, and the X-shaped supporting legs are folded after a series of operations of the parts in the opposite directions, and the motor is stopped until the tabletop plate 1 is lowered to a proper position. When the lifting table descends to the lowest position, the motor 3 is forced to stop by the limit of the tact switch 18 to achieve safe operation.

Although certain embodiments have been illustrated and described herein for purposes of description, a wide variety of alternate and/or equivalent embodiments or implementations to achieve the same purposes may be substituted for the embodiments shown and described without departing from the scope of the present disclosure. This application is intended to cover any adaptations or variations of the embodiments discussed herein, for example, the structure of the power driving device can also be a hydraulic cylinder device instead of a screw rod and a slider; a free end of the piston rod of the hydraulic cylinder device be connected with the X-shaped support leg; or through the transmission of the gear and gear rack, the output shaft of the motor outputs power to the X-shaped support leg, that is, the gear is driven to rotate by the motor output shaft, the meshing of the gear and the gear rack makes the rack move linearly, and the end of the rack is connected with the X-shaped supporting leg, and the like.

We claim:

1. A lifting table, comprising:

a tabletop plate(1), a table-supporting frame connected with the tabletop plate(1), a base (2), an X-shaped supporting leg for connecting the table-supporting frame and the base (2), and a power driving device controlling the open-and-close of the X-shaped supporting leg to achieve the lifting of the tabletop plate (1), wherein the power driving device is connected to the table-supporting frame, and the power output end of the power driving device is connected with the X-shaped supporting leg;

wherein the lifting table further comprises an inclined connecting rod mechanism which applies an oblique force to the X-shaped supporting leg; one end of the inclined connecting rod mechanism is connected to the X-shaped supporting leg, and the other end of the inclined connecting rod mechanism is connected to the power driving device;

wherein the inclined connecting rod mechanism comprises a long connecting rod (5) and a short connecting rod (4); one end of the long connecting rod (5) is hinged to the power output end of the power driving device and the other end of the long connecting rod (5) is hinged to one end of the short connecting rod (4) respectively; the other end of the short connecting rod (4) are in fixed connection with the X-shaped supporting leg; and an included angle is always formed between the long connecting rod (5) and the power output direction of the power driving device.

2. The lifting table of claim 1, wherein the power driving device comprises a motor connecting seat (14), a motor (3), a screw rod (16), and a slider (17); the motor connecting seat (14) is connected onto the tabletop plate (1) and the motor (3) is fixedly connected onto the motor connecting seat (14); an output shaft of the motor (3) is connected with one end of the screw rod (16) through a transmission mechanism; the slider (17) is in threaded connection with the screw rod (16); the other end of the screw rod (16) is rotationally connected with the table-supporting frame while the slider (17) is hinged with one end of the long connecting rod (5).

3. The lifting table of claim 2, wherein the table-supporting frame comprises two cross beams (6) and two guide rails (15); the two cross beams (6) are connected to the front and rear side of the tabletop plate (1) respectively; the motor (3) is connected to one end of the cross beam (6), and the two guide rails (15) are respectively connected to one end of the two cross beams(6), the end of which is far away from the motor (3).

4. The lifting table of claim 3, wherein the X-shaped supporting leg comprises two X-shaped supporting sets; each X-shaped supporting set is formed by a first supporting leg (11) and a second supporting leg (12) hinged into an X-shape cross; each X-shaped supporting set consists of four supporting points: a first supporting point for the connection of the table-supporting frame and one end of the first supporting leg (11); a second supporting point for the connection of the table-supporting frame and one end of the second supporting leg (12); a third supporting point for the connection of the base (2) and the other end of the first supporting leg (11); a fourth supporting point for the connection of the base (2) and the other end of the second supporting leg (12); the second supporting points of the two X-shaped supporting sets are connected with each other through a second connecting shaft (7); the fourth supporting points of the two X-shaped supporting sets are connected with each other through a fourth connecting shaft (8); the two ends of the second connecting shaft (7) are respectively hinged into the two guide rails (15) in a sliding connection; the two ends of the fourth connecting shaft (8) are respectively hinged onto the base (2) in a sliding connection; the first supporting point is hinged to one end of the cross beam (6), the end of which close to the motor (3); the third supporting point is hinged on the base (2); one end of the short connecting rod (4) is fixedly connected to the end of the first supporting leg (11), the end of which close to the end of the tabletop plate (1).

5. The lifting table of claim 4, wherein the first supporting points of the two X-shaped supporting leg sets are connected with each other through a first connecting shaft (19); the two ends of the first connecting shaft (19) are hinged to the two cross beams (6) respectively; the two ends of the two first supporting legs (11) are fixedly connected to the outer circumferential wall of the first connecting shaft (19).

6. The lifting table of claim 3, wherein an intermediate beam (9) is arranged between the middle portions of the two cross beams (6); the two ends of the intermediate beam (9) are fixedly connected with the two cross beams (6) respectively; a hanging plate (13) is connected to the intermediate beam (9), and the other end of the screw rod (16) is hinged to the hanging plate (13).

7. The lifting table of claim 6, wherein a housing (10) is provided outside the screw rod (16) and the slider (17); the end of the housing (10) is fixedly connected with the hanging plate (13).

8. The lifting table of claim 2, wherein a tact switch (18) is arranged at the bottom of the motor (3) to prevent the motor (3) from colliding with the base (2) when the tabletop plate (1) is lowered to the lowest position; the contact point of the tact switch (18) facing to the base (2).

* * * * *